United States Patent [19]

Garwood et al.

[11] 4,283,272

[45] Aug. 11, 1981

[54] MANUFACTURE OF HYDROCRACKED LOW POUR LUBRICATING OILS

[75] Inventors: William E. Garwood, Haddonfield; Murray R. Silk, Cherry Hill, both of N.J.

[73] Assignee: Mobil Oil Corporation, New York, N.Y.

[21] Appl. No.: 159,011

[22] Filed: Jun. 12, 1980

[51] Int. Cl.[3] ..... C10G 47/16; C10G 49/22

[52] U.S. Cl. ..... 208/59; 208/95; 208/100; 208/103

[58] Field of Search ..... 208/59, 18, 95, 100, 208/103

[56] References Cited

U.S. PATENT DOCUMENTS

| | | | |
|---|---|---|---|
| 3,852,207 | 12/1974 | Stangeland et al. | 208/58 |
| 4,137,148 | 1/1979 | Gillespie et al. | 208/87 |
| 4,162,962 | 7/1979 | Stangeland et al. | 208/58 |
| 4,181,598 | 1/1980 | Gillespie et al. | 208/58 |
| 4,183,801 | 1/1980 | Breuker et al. | 208/59 |
| 4,238,316 | 12/1980 | Mooi et al. | 208/58 |

*Primary Examiner*—Delbert E. Gantz
*Assistant Examiner*—G. E. Schmitkons
*Attorney, Agent, or Firm*—C. A. Huggett; M. G. Gilman; V. J. Frilette

[57] ABSTRACT

Hydrocracked, low pour lubricating oils of good stability are manufactured by passing a suitable hydrocarbon feed and hydrogen sequentially through a hydrocracking zone, a catalytic dewaxing zone, and a hydrotreating zone, all at high pressure and in that order, with purification of the hydrogen gas prior to passage to the dewaxing zone. By maintaining all zones at high pressure, the efficiency of the process is augmented.

15 Claims, 2 Drawing Figures

PROCESS FLOW DIAGRAM

MANUFACTURE OF HYDROCRACKED LOW POUR LUBRICATING OILS

BACKGROUND OF THE INVENTION

1. Field of the Invention

This invention is concerned with a process for the manufacture of lubricating oils. In particular, it is concerned with a particular combination of unit processes whereby a hydrocracked lube oil of good stability and low pour point is produced with high energy efficiency.

2. Prior Art

Refining suitable petroleum crude oils to obtain a variety of lubricating oils which function effectively in diverse environments has become a highly developed and complex art. Although the broad principles involved in refining are qualitatively understood, the art is encumbered by quantitative uncertainties which require considerable resort to empiricism in practical refining. Underlying these quantitative uncertainties is the complexity of the molecular constitution of lubricating oils. Because lubricating oils for the most part are based on petroleum fractions boiling above about 450° F., the molecular weight of the hydrocarbon constituents is high and these constituents display almost all conceivable structures and structure types. This complexity and its consequences are referred to in "Petroleum Refinery Engineering", by W. L. Nelson, McGraw Hill Book Company, Inc., New York, N.Y., 1958 (Fourth Edition), relevant portions of this text being incorporated herein by reference for background.

In general, the basic notion in lubricant refining is that a suitable crude oil, as shown by experience or by assay, contains a quantity of lubricant stock having a predetermined set of properties such as, for example, appropriate viscosity, oxidation stability, and maintenance of fluidity at low temperatures. The process of refining to isolate that lubricant stock consists of a set of subtractive unit operations which removes the unwanted components. The most important of these unit operations include distillation, solvent refining, and dewaxing, which basically are physical separation processes in the sense that if all the separated fractions were recombined one would reconstitute the crude oil.

Unfortunately, crude oils suitable for the manufacture of lubes are becoming less available due to exhaustion of reserves, and the reliability of a steady, adequate supply from a known source is a matter of concern due to political instability.

The desirability of upgrading a crude fraction normally considered unsuitable for lubricant manufacture to one from which good yields of lubes can be obtained has long been recognized. The so-called "hydrocracking process", sometimes referred to in the art as "severe hydrotreating", has been proposed to accomplish such upgrading. In this process, a suitable fraction of a poor grade crude, such as a California crude, is catalytically reacted with hydrogen under pressure. The process is complex in that some of the oil is reduced in molecular weight and made unsuitable for lubes, but concurrently a substantial fraction of the polynuclear aromatics is hydrogenated and cracked to form naphthenes and paraffins. Process conditions and choice of catalyst are selected to provide an optimal conversion of the polynuclear aromatic content of the stock, since this component degrades the viscosity index and stability of the stock. Also, in the hydrocracking process, paraffins can be isomerized, imparting good V.I. characteristics to the final lube product. For purposes of this invention, the term "hydrocracking" will be employed for the foregoing process step and to distinguish this step from the "hydrotreating" step to be described below, the purpose of the latter being to stabilize the lube base stock produced by hydrocracking. For purposes of this invention, the hydrocracking and hydrotreating steps may be distinguished also by the amount of hydrogen consumed, the hydrocracking step typically consuming about 1000–2000 SCF/bbl (standard cubic feet per barrel of feed) while the hydrotreating step consumes only about 100–200 SCF/bbl.

The hydrocracking process for increasing the availability of lube oils has an attractive feature that is not immediately apparent. Generally, the composition and properties of hydrocracked stocks are not particularly affected by the source and nature of the crude, i.e. they tend to be much more alike than lube fractions prepared from different crudes by conventional means. Thus, the process promises to free the refiner from dependence on a particular crude, with all of the advantages that this freedom implies.

Hydrocracked lube stocks, however, tend to be unstable in the presence of air when exposed to sunlight. On such exposure, a sludge is formed, sometimes very rapidly and in fairly substantial amount. This tendency in a lubricating oil is unacceptable. Additionally, some hydrocracked lube oils tend to darken or to form a haze.

Several methods have been proposed to correct the above-described instability. U.S. Pat. No. 4,031,016 to Berger et al proposes to add certain antioxidants to the hydrocracked oil. A second proposed approach is to hydrotreat the hydrocrackate. Variants of this approach are described in U.S. Pat. No. 3,666,657 which utilizes a sulfided mixture of an iron group metal and a Group VI metal for the hydrotreating stage; U.S. Pat. No. 3,530,061 which utilizes a hydrotreating catalyst having one or more elements from Group IIB, VIB and VIII at hydrogen pressure up to about 100 psig; and U.S. Pat. No. 4,162,962 which teaches to hydrotreat the hydrocrackate at a temperature in the 200° to 300° C. range with a catalyst of prescribed pore size. U.S. Pat. No. 3,530,061 to Orkin et al utilizes a non-cracking support for the hydrotreating stage. U.S. Pat. No. 3,852,207 to Stangeland et al teaches to hydrotreat with a noble metal hydrogenation component supported on an oxide. The patents cited above are believed representative of the state of the art, and each is incorporated herein by reference.

Hydrocracked lubricating oils generally have an unacceptably high pour point and require dewaxing. Solvent dewaxing is a well-known and effective process but expensive. More recently catalytic methods for dewaxing have been proposed. U.S. Pat. No. Re. 28,398 to Chen et al describes a catalytic dewaxing process wherein a particular crystalline zeolite is used. To obtain lubricants and specialty oils with outstanding resistance to oxidation, it is often necessary to hydrotreat the oil after catalytic dewaxing, as illustrated by U.S. Pat. No. 4,137,148 to Gillespie et al. The foregoing patents are incorporated herein by reference as background, and indicate the state of the dewaxing art.

It is inferentially evident from the foregoing background material that the manufacture of modern high quality lubricants in general requires that the crude be treated in a sequence of fairly complex and costly steps. It is further evident that there is a need for processes which can efficiently provide such lubricants from interchangeable and readily available low grade crudes.

It is an object of the present invention to provide an improved process for the manufacture of hydrocracked lubricating oils. It is a further object to provide a method for manufacturing hydrocracked lubricating oils having a low pour point and good resistance to light. It is a further object of this invention to provide an energy-efficient process for manufacturing hydrocracked lubricating oils. These and other objects will become evident to one skilled in the art on reading this entire specification including the appended claims.

SUMMARY OF THE INVENTION

Figure 1:
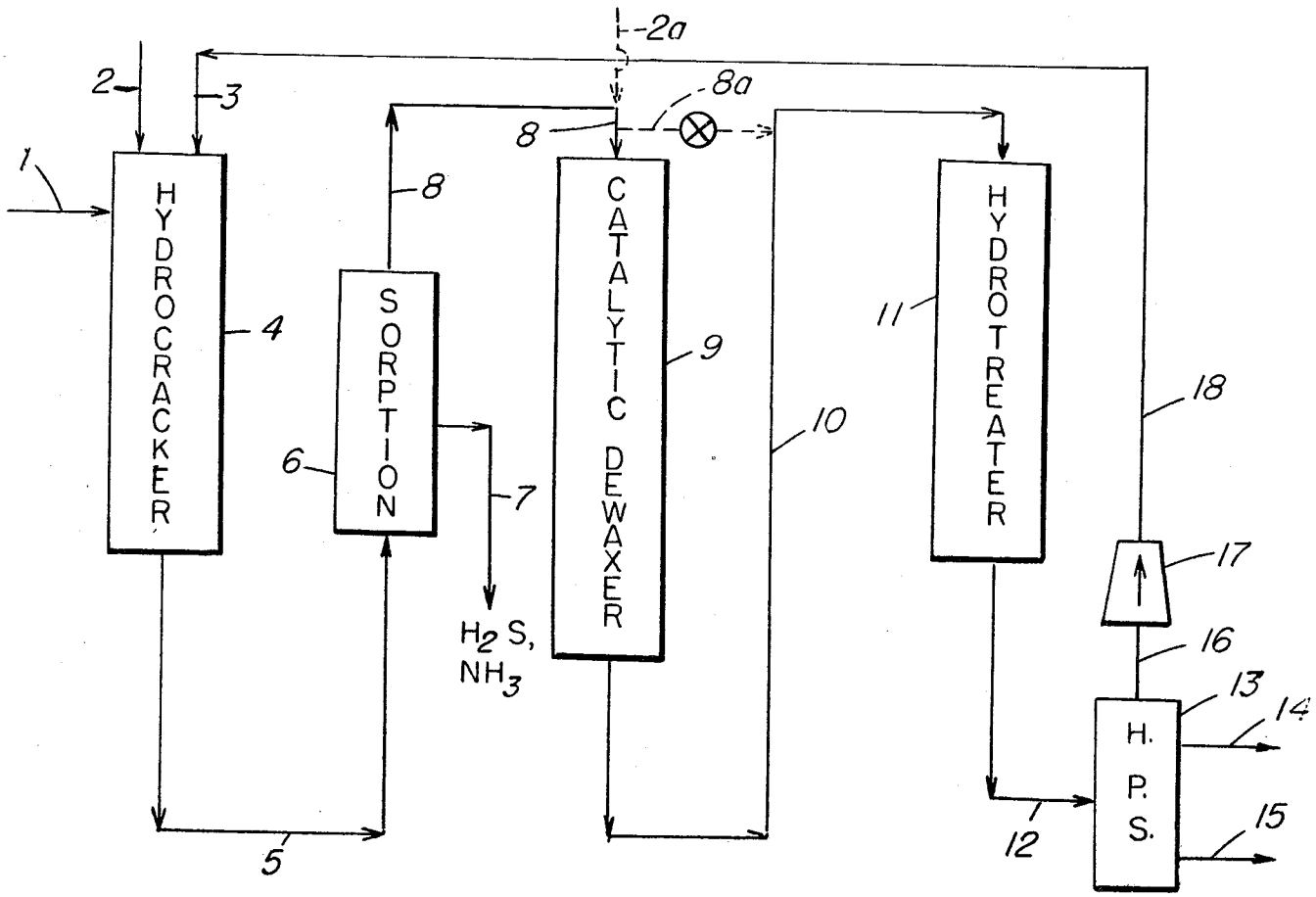
FIG. 1 Process flow diagram illustrates relation of process units with single hydrogen recycle loop.

This invention provides an energy-efficient process for manufacturing a stabilized and dewaxed hydrocracked lubricating oil stock from a hydrocarbon feedstock boiling above about 650° F. (343° C.), such as vacuum gas oils, and resids substantially free of asphaltenes. The process comprises passing the feed and hydrogen gas sequentially through a hydrocracking zone, a sorption section for removing hydrogen sulfide and ammonia contaminants, a catalytic dewaxing zone provided with a dewaxing catalyst exemplified by ZSM-5 and a hydrotreating zone at high pressure conditions in each of said zones such that hydrogen recycle is effected with minimal recompression, thus providing a single hydrogen recycle loop for all three zones, as more fully described hereinbelow. Additionally, the effluent hydrogen from the hydrocracking zone is treated to remove at least a substantial portion, i.e. at least 50%, of the $H_2S$ and of the ammonia produced in the hydrocracking zone, as more fully described below.

The process provided by this invention with the catalytic dewaxing step following the hydrocracking step and preceding the stabilization step requires only one stabilizing step and only one hydrogen loop, and the equipment is therefore simple and provides low-cost and reliable operation. In a preferred embodiment of this invention the hydrogen recirculation is maintained with a pressure difference not greater than about 750 psig between the inlet and outlet of a single compressor, which may be a multi-stage compressor.

EMBODIMENTS

The process of this invention will now be illustrated by reference to FIG. 1 of the drawing.

The feed, which may be any hydrocarbon feedstock boiling above about 650° F. (343° C.), such as a heavy neutral oil or a deasphalted residuum, is introduced via line 1 together with makeup hydrogen via line 2 and recycle hydrogen via line 3 to hydrocracker section 4. Hydrocracker section 4 includes a catalytic hydrocracking zone at conditions effective to convert in a single pass at least 20% of the feed to materials boiling below the initial boiling point of said feed.

Figure 2:
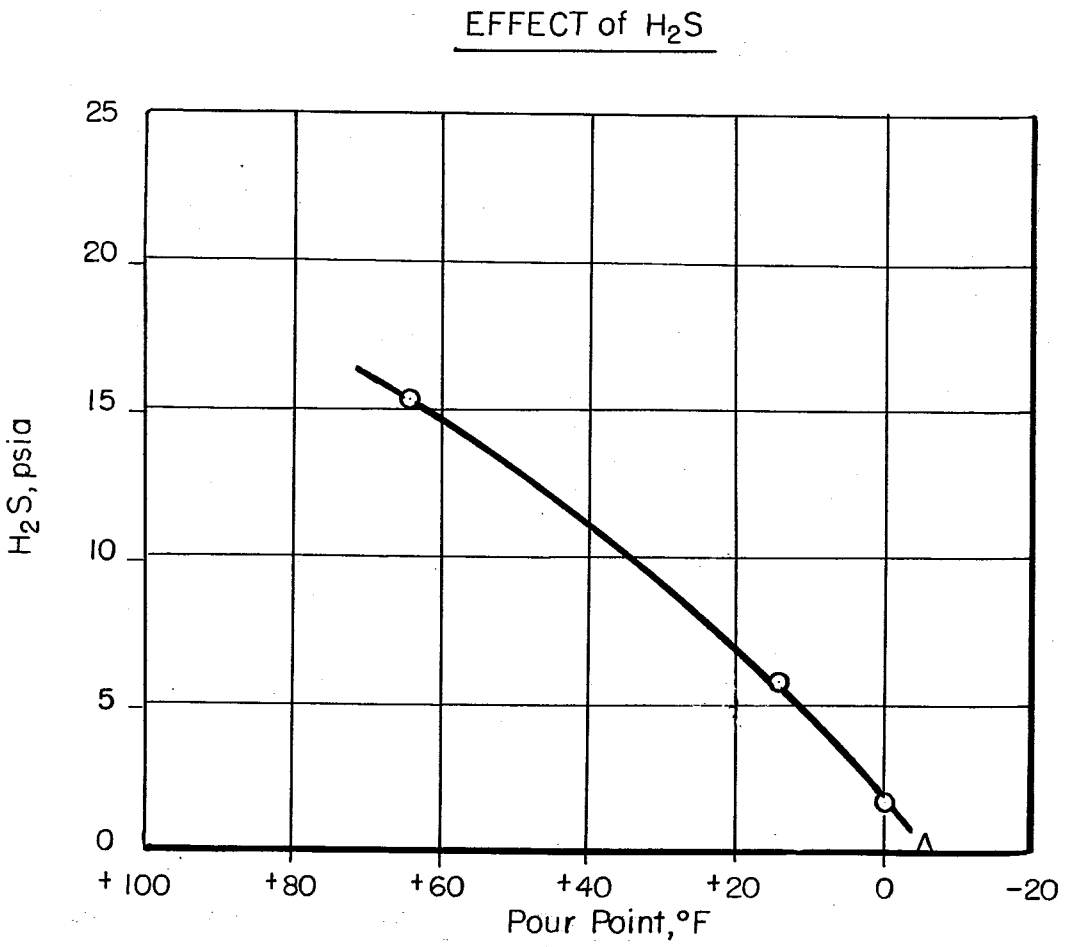
FIG. 2 Effect of $H_2S$ on pour-point reduction.

The effluent from the hydrocracker 4 including excess hydrogen will be contaminated with free hydrogen sulfide and in some cases with ammonia, since the hydrocracking step, in addition to saturating aromatic compounds, also is accompanied by desulfurization and denitrogenation. At least a portion of the hydrogen sulfide is removed from the excess hydrogen by passage via line 5 to a high pressure sorption section 6, which may include a gas-liquid separator. In this section, at least sufficient hydrogen sulfide is removed from the system via line 7 to reduce its partial pressure at the inlet to the catalytic dewaxing section to less than about 5 psia, and preferably to less than about 2 psia. If $H_2S$ is allowed to build up in the effluent passing on to the catalytic dewaxing zone utilizing ZSM-5, for example, the activity of the dewaxing catalyst will be adversely affected as shown in FIG. 2. For example, an $H_2S$ partial pressure of 15 psia lowers activity of the dewaxing catalyst so that pour point is about 80° F. higher than if no $H_2S$ is present. This adverse effect can be overcome by raising temperature, but higher temperatures cause increased catalyst coking and decreased cycle time. It is thus highly desirable to remove the $H_2S$ from the process stream to the level above described. For similar reasons, it is most desirable in that same sorption section 6 to remove ammonia from the hydrogen gas so that the ammonia content of the gas at the inlet to the dewaxing section is less than about 100 ppm (i.e. 100 parts $NH_3$ by weight per million parts of gas).

The effluent from the sorption unit 6 including excess hydrogen is passed via line 8 to catalytic dewaxing unit 9 wherein is contained a dewaxing catalyst in a dewaxing zone at dewaxing conditions.

Various zeolitic dewaxing catalyst, with or without hydrogenation component, may be used in dewaxing unit 9. For example, the mordenite catalyst in the hydrogen form and containing a Group VI or Group VIII metal, as described in U.S. Pat. No. 4,100,056 to Reynolds is suitable. Also useful and in fact preferred is ZSM-5 associated with a hydrogenation component as more fully described in U.S. Pat. No. Re. 28,398. Another preferred zeolite is ZSM-11 associated with a hydrogenation component such as nickel or palladium. ZSM-11 is more fully described in U.S. Pat. No. 3,709,979 issued Jan. 9, 1973. The foregoing patents are incorporated herein by reference. The preferred dewaxing catalyst comprises ZSM-5 or ZSM-11.

The effluent from the catalytic dewaxer, including excess hydrogen, is passed via line 10 to hydrotreater unit 11. Catalytic hydrotreater 11 contains a hydrotreating catalyst in a hydrotreating zone at stabilizing conditions. The effluent from the hydrotreater unit is passed via line 12 to a high pressure separation section 13 wherein recycle hydrogen, a hydrogen bleed, light hydrocarbons, and a hydrocarbon mixture comprising a stabilized and dewaxed hydrocracked lubricating oil stock are separated from one another. The hydrogen bleed and light hydrocarbons are removed from the system via one or more lines 14. The hydrocarbon mixture containing the lubricating oil stock is passed from high pressure separator 13 via line 15 to another unit for recovery of the lubricating oil stock, which other unit is not part of this invention. The recycle hydrogen separated in section 13 is passed via line 16 to pump 17 to raise its pressure and then passed via line 18 and line 3 as recycle to the hydrocracker 4.

In the preferred mode of operation, the pressure in line 16, which is downstream from pump 17, and the pressure in line 18, which is upstream of pump 17, do not differ by more than about 750 psig.

The embodiment shown in FIG. 1 of the process of this invention illustrates the essential feature of the invention, which is to provide a single hydrogen loop for processing a hydrocarbon oil by the sequence of steps comprising hydrocracking, catalytic dewaxing and stabilization, in that order. It is known that hydrocracking by itself results in an unstable oil, and catalytic dewaxing in some instances also contributes to instability. By disposing the catalytic dewaxing step between the hydrocracking and stabilization step in the manner described in this invention, a very efficient process results with the production of a stabilized and dewaxed hydrocracked lubricating oil stock.

It will be recognized by those skilled in the art that various separation steps conducted at high pressure may be advantageously incorporated in the process flow diagram of FIG. 1. For example, a high pressure separation unit may be located in line 5 or line 8 or line 10, for example, to remove a low molecular weight fraction of hydrocarbon not suitable for inclusion in the final lubricant base stock, thereby reducing the hydrocarbon load to subsequent sections.

It will also be evident to those skilled in the art that the embodiment of this invention illustrated by FIG. 1 creates a pressure gradient which decreases as the treated stock is advanced from the hydrocracker to the catalytic dewaxer to the hydrotreater. This pressure gradient is, of course, necessary to provide flow through the units. There may be instances in which it is desirable to operate the hydrocracker at a lower pressure than the catalytic dewaxer, which modification is readily achieved by placing pump 17 in line 8 instead of between lines 16 and 18. Other positions for the recycle pump 17, such as in line 10, may in some instances be desirable, depending on the particular optimal conditions selected for each of the three steps. In all instances, however, a single recycle hydrogen loop is maintained and the feed is processed in the sequence of steps which comprise hydrocracking, dewaxing and stabilization, in that order. Modifications such as placing the dewaxing zone and the hydrotreating zone in a single reactor, which may be done with suitable reactor design, are contemplated as within the scope of this invention.

Another variant contemplated as within the scope of this invention is to introduce substantially all or all of the makeup hydrogen via line 2*a* into the catalytic dewaxing section instead of into the hydrocracking section, thus reducing the amount passed via line 2, or even eliminating line 2 altogether. This means of introduction has the advantage that the removal of $H_2S$ and $NH_3$ in sorption unit 6 is facilitated since, with reduced hydrogen flow through hydrocracking section 4 the concentration of contaminants passed via line 5 would be increased.

Another variant contemplated is to by-pass a portion of the purified hydrogen fed via line 8 to the dewaxer so that it goes directly to the hydrotreater section. This by-pass option is shown in FIG. 1 as dotted line 8*a*, which includes a valve or orifice which determines the amount of hydrogen by-passed.

The reaction conditions for the catalytic process steps herein described are summarized in Table I.

TABLE I

| | Hydro-cracking | Dewaxing | Hydro-treating |
|---|---|---|---|
| Pressure, broad, psig | 1000–3000 | same | same |
| Pressure, preferred | 1500–2500 | same | same |
| Temperature, broad, °F. | 500–900 | 450–900 | 350–700 |
| Temperature, broad, °C. | 260–482 | 232–482 | 176–371 |
| Temperature, preferred, °F. | 650–800 | 525–800 | 400–600 |
| Temperature, preferred, °C. | 343–427 | 274–426 | 204–316 |

TABLE I-continued

| | Hydro-cracking | Dewaxing | Hydro-treating |
|---|---|---|---|
| LHSV,* broad | 0.1–5.0 | 0.2–20 | 0.1–10 |
| LHSV, preferred | 0.5–2.0 | 0.5–5 | 0.2–3.0 |
| $H_2$ gas, SCF/bbl, broad | 1000–20,000 | 500–20,000 | 500–20,000 |
| $H_2$ gas, SCF/bbl, preferred | 2000–10,000 | 500–3000 | 500–3000 |

*LHSV = liquid hourly space velocity, i.e. volumes of feed per volume of catalyst per hour.

Although the catalytic process steps per se individually are not regarded as part of this invention, it is here noted that a wide variety of hydrocracking catalysts are contemplated as suitable for use in the process of this invention. Such catalysts in general possess an acid function and a hydrogenation function, exemplified by a porous acidic oxide such as a silica alumina or silica zirconia associated with a nickel-tungsten or palladium or platinum, or cobalt-moly or nickel-moly component. In general, a Group VIII metal or a combination of a Group VI and a Group VIII metal, as the oxides or sulfides thereof, deposited on silica alumina or silica zirconia, may serve as hydrocracking catalyst. The hydrocracking itself may be conducted in two or more stages, with pretreatment of the raw feed as part of the first stage. Catalyst suitable for the dewaxing and hydrotreating steps have been described above.

Attention is called to U.S. patent application Ser. No. 158,980, filed on even date herewith which is concerned with subject matter related to but different from that of the present application.

What is claimed is:

1. A continuous process for producing a dewaxed lubricating oil base stock characterized by good stability on exposure to light and air from a hydrocarbon feedstock boiling above about 650° F. (343° C.), which process comprises:

hydrocracking said feedstock in a hydrocracker section containing a hydrocracking zone at hydrocracking conditions including a pressure of 1000 to 3000 psig, said conditions being effective to convert at least 20 volume percent of said feedstock to materials boiling below the initial boiling point of said feedstock, said conversion being accompanied by the consumption of hydrogen and the formation of hydrogen sulfide and ammonia contaminants;

passing the hydrocracker effluent comprising hydrocrackate and contaminated hydrogen gas to a sorption section wherein a substantial fraction of said hydrogen sulfide and ammonia contaminants are removed;

passing the effluent from said sorption section, including purified hydrogen gas, to a catalytic dewaxing section wherein the hydrocrackate is catalytically dewaxed in a high pressure dewaxing zone;

passing the effluent from the catalytic dewaxing section, comprising dewaxed hydrocrackate and hydrogen gas to a high pressure hydrotreating zone operated at conditions effective to stabilize the lube base stock in said hydrocrackate;

passing the hydrotreater effluent to a high pressure separator section thereby recovering hydrogen gas and hydrocarbons comprising said dewaxed, stable lubricating oil base stock;

passing makeup hydrogen gas into at least one of said sections and in an amount at least equal to the hydrogen consumed in the hydrocracker section;

recycling said recovered hydrogen gas to said hydrocracker; and maintaining the circulation of said gas in said process by repressuring said gas by not more than about 750 psi.

2. The process described in claim 1 wherein said dewaxing catalyst comprises ZSM-5 or ZSM-11.

3. The process described in claim 2 wherein said catalytic dewaxing is conducted at a pressure of about 1000 to 3000 psig, a temperature of about 525° F. (274° C.) to 800° F. (426° C.), and a L.H.S.V. of 0.2 to 20.

4. The process described in claim 1 wherein said makeup hydrogen is passed into said hydrocracker section.

5. The process described in claim 1 wherein said makeup hydrogen is passed to said catalytic dewaxing section.

6. The process described in claim 2 wherein said makeup hydrogen is passed to said catalytic dewaxing section.

7. The process described in claim 3 wherein said makeup hydrogen is passed to said catalytic dewaxing section.

8. The process described in claim 1 wherein sufficient hydrogen sulfide and ammonia are removed from the hydrogen gas in said sorption section to provide a partial pressure of less than about 5 psia of hydrogen sulfide and less than 100 ppm of ammonia at the inlet of said catalytic dewaxing section.

9. The process described in claim 2 wherein sufficient hydrogen sulfide and ammonia are removed from the hydrogen gas in said sorption section to provide a partial pressure of less than about 5 psia of hydrogen sulfide and less than 100 ppm of ammonia at the inlet of said catalytic dewaxing section.

10. The process described in claim 3 wherein sufficient hydrogen sulfide and ammonia are removed from the hydrogen gas in said sorption section to provide a partial pressure of less than about 5 psia of hydrogen sulfide and less than 100 ppm of ammonia at the inlet of said catalytic dewaxing section.

11. The process described in claim 4 wherein sufficient hydrogen sulfide and ammonia are removed from the hydrogen gas in said sorption section to provide a partial pressure of less than 5 psia of hydrogen sulfide and less than 100 ppm of ammonia at the inlet of said catalytic dewaxing section.

12. The process described in claim 5 wherein sufficient hydrogen sulfide and ammonia are removed from the hydrogen gas in said sorption section to provide a partial pressure of less than about 5 psia of hydrogen sulfide and less than 100 ppm of ammonia at the inlet of said catalytic dewaxing section.

13. The process described in claim 6 wherein sufficient hydrogen sulfide and ammonia are removed from the hydrogen gas in said sorption section to provide a partial pressure of less than about 5 psia of hydrogen sulfide and less than 100 ppm of ammonia at the inlet of said catalytic dewaxing section.

14. The process described in claim 7 wherein sufficient hydrogen sulfide and ammonia are removed from the hydrogen gas in said sorption section to provide a partial pressure of less than about 5 psia of hydrogen sulfide and less than 100 ppm of ammonia at the inlet of said catalytic dewaxing section.

15. The process described in claim 1 or 2 or 3 or 4 wherein a portion of the purified hydrogen gas effluent from said sorption section is by-passed to said hydrotreating zone.

* * * * *